US006175701B1

(12) United States Patent
Kwon

(10) Patent No.: US 6,175,701 B1
(45) Date of Patent: Jan. 16, 2001

(54) CLEANING BLADES IN IMAGE FORMING APPARATUS IN TANDEM CONFIGURATION

(75) Inventor: Tai-Eun Kwon, Kumi (KR)

(73) Assignee: SamSung Electronics Co., Ltd., Suwon (KR)

( * ) Notice: Under 35 U.S.C. 154(b), the term of this patent shall be extended for 0 days.

(21) Appl. No.: 09/317,445

(22) Filed: May 24, 1999

(30) Foreign Application Priority Data

Nov. 23, 1998 (KR) ..... 98-22835

(51) Int. Cl.[7] ..... G03G 21/00
(52) U.S. Cl. ..... 399/100; 399/350; 399/360
(58) Field of Search ..... 399/99, 100, 101, 399/350, 358, 360, 281

(56) References Cited

U.S. PATENT DOCUMENTS

| | | | | |
|---|---|---|---|---|
| 4,947,216 | | 8/1990 | Surti . | |
| 5,168,309 | | 12/1992 | Adachi et al. . | |
| 5,608,499 | * | 3/1997 | Tanaka | 399/99 |
| 5,617,194 | | 4/1997 | Morishita et al. . | |
| 5,640,663 | | 6/1997 | Hirai et al. . | |
| 5,799,229 | | 8/1998 | Yokoyama et al. . | |
| 5,812,917 | * | 9/1998 | Iwata et al. | 399/281 |
| 5,873,013 | | 2/1999 | Matsushita et al. . | |

FOREIGN PATENT DOCUMENTS

| | | | |
|---|---|---|---|
| 3-100676 | * | 4/1991 | (JP) . |
| 7-20692 | * | 1/1995 | (JP) . |

* cited by examiner

*Primary Examiner*—Joan Pendegrass
(74) *Attorney, Agent, or Firm*—Robert E. Bushnell, Esq.

(57) ABSTRACT

An electrophotographic image forming apparatus. The image forming, apparatus includes an organic photoconductive (OPC) drum for forming an image, a charging roller for applying a high voltage to the OPC drum, a developing roller for supplying toner to the OPC drum, a doctor blade for regulating of a toner layer to a predetermined thickness on the developing roller, a supply roller for supplying the toner to the developing roller, an agitator for supplying the, toner to the supply roller, a first cleaning blade formed on a portion of a predetermined frame at a side of the OPC drum, for scraping non-transferred roller on the OPC drum after a transferring operation, and a second cleaning blade formed on another portion of the frame above the first cleaning blade, at a side of the charging roller, for completely scraping non-transferred toner which avoids the cleaning operation of the first cleaning blade. Thus, high quality image can be obtained by preventing non-transferred toner-caused contamination of the OPC drum.

18 Claims, 3 Drawing Sheets

CLEANING BLADES IN IMAGE FORMING APPARATUS IN TANDEM CONFIGURATION

CLAIM OF PRIORITY

This application makes reference to, incorporates the same herein, and claims all benefits accruing under 35 U.S.C. §119 from an application for Cleaning Blades in Image Forming Apparatus earlier filed in the Korean Industrial Property Office on Nov. 23, 1998 and there duly assigned Ser. No. 22835/1998.

FIELD OF THE INVENTION

The present invention relates to an electrophotographic image forming apparatus, and in particular, to cleaning blades for simultaneously removing non-transferred toner from an OPC (Organic Photoconductive) drum and a charging roller after a toner image is developed from an electrostatic latent image on the surface of the OPC drum by a developing roller and transferred onto a recording paper sheet.

DESCRIPTION OF THE RELATED ART

U.S. Pat. No. 4,947,216 for a Cleaning Blade Assembly For Electrophotography Apparatus to Surti discloses a cleaning apparatus for cleaning toner from a photosensitive drum. The cleaning apparatus contains a blade for scraping residual toner off the photosensitive drum and a housing for storing toner that has been scraped off the photosensitive drum. The reference makes no mention of a charging roller or a method or apparatus for scrapping toner from a charging roller.

U.S. Pat. No. 5,873,013 for an Image Forming Apparatus Provided With Contact-Type Charger And Controller For Cleaning Charger to Matsushita et al. discloses; a charging member that can be cleaned of toner. However, the charging member is not in the form of a roller but is in the form of a blade.

What is needed is a blade for cleaning a charging roller in addition to a blade for cleaning a photoconductive drum in an electrophotographic apparatus. The blade for cleaning the charging roller cleans toner that was not transferred to the sheet of paper and has avoided the cleaning operation of the photoconductive drum. What is also needed is a frame that contains both blades and a housing for storing waste toner scraped off the photoconductive drum.

SUMMARY OF THE INVENTION

To overcome the above earlier problem, an object of the present invention is to provide cleaning blades in an image forming apparatus, for removing non-transferred toner remaining on an OPC drum and a charging roller after a transferring process.

Another object of the present invention is to provide cleaning blades in an image forming apparatus, for removing non-transferred toner remaining an OPC drum and a charging roller to thereby increase image quality.

It is still another object to provide a charging roller with a cleaning blade.

It is yet another object to provide a single frame that contains the two blades, one for cleaning the photoconductive drum and one for cleaning the charging roller, wherein the frame also contains a waste reservoir for storing waste toner scraped by the first blade off the photoconductive drum.

To achieve the above objects, there is provided an electrophotographic image forming apparatus. The image forming apparatus includes an OPC drum for forming in image, a charging roller for applying a high voltage to the OPC drum, a developing roller for supplying toner to the OPC drum, a doctor blade for regulating of a toner layer to a predetermined thickness on the developing roller, a supply roller for supplying the toner to the developing roller, an agitator for supplying the toner to the supply roller, a first cleaning blade formed on a portion of a predetermined frame at a side of the OPC drum, for scraping non-transferred roller on the OPC drum after a transferring operation, and a second cleaning blade formed on another portion of the frame above the first cleaning blade, at a side of the charging roller, for completely scraping non-transferred toner which avoids the cleaning operation of the first cleaning blade. Thus, high quality image can be obtained by preventing non-transferred toner- caused contamination of the OPC drum.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
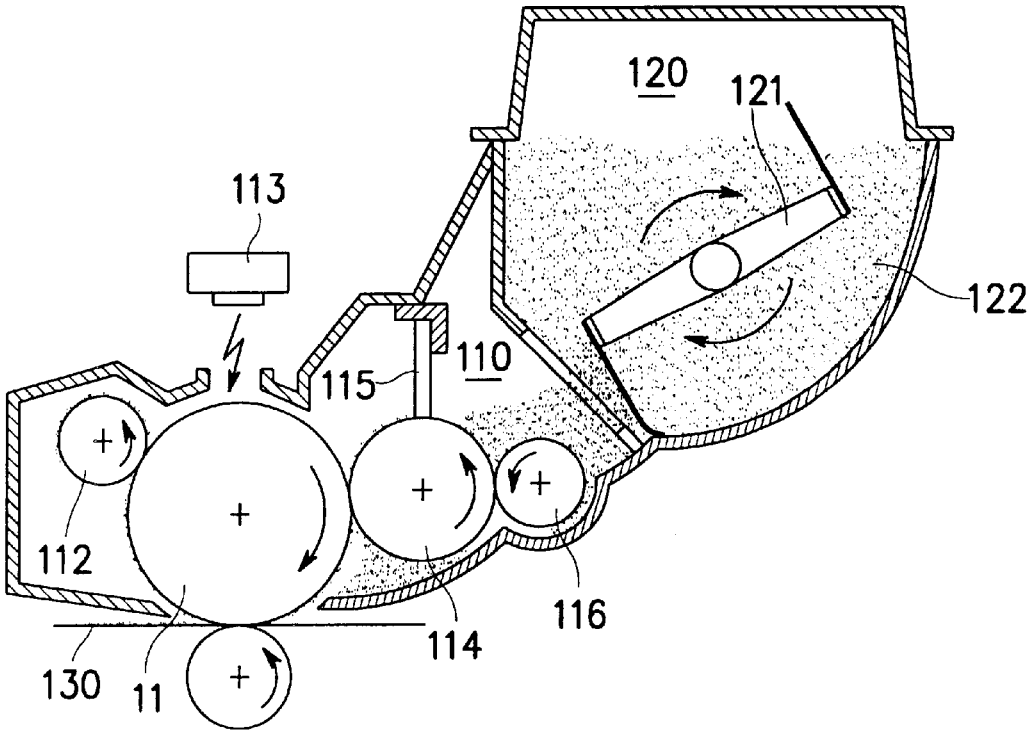
FIG. 1 is a schematic view of an earlier image forming apparatus.

FIG. 1 is a schematic diagram of an earlier image forming apparatus without a cleaner. Referring to FIG. 1, the earlier image forming apparatus includes a toner chamber 120 containing a large amount of toner 122 and a developer chamber 110 for forming an image on a paper sheet 130 with the toner 122 fed from the toner chamber 120. The toner chamber 120 and the developer a chamber 110 form a developer cartridge in a predetermined frame.

An OPC drum 111 is installed in an appropriate portion of the developer chamber 110, partially protruding from the lower surface of the cartridge, and rotates at a predetermined circumferential speed. At one side of the OPC drum 111 is rotatably installed a charging roller 112 for charging the surface of the OPC drum 111 with a high voltage. An exposer 113 is installed in a body above the OPC drum 111, for exposing the OPC drum 111 charged by the charging roller 112 is to produce an electrostatic latent image. A developing roller 114 is rotatably installed at the other side of the OPC drum 111, for sticking the toner 122 onto the electrostatic latent image-present 17 portion of the OPC drum 111. A doctor blade 115 has one end fixed to the frame of the developer chamber 110 and the other end in contact with the outer circumferential surface of the developing roller 114, for forming a predetermined toner layer on the surface of the developing roller 114. A supply roller 116 is provided opposite to the OPC drum 111 with interposition of the developing roller 114, for supplying the toner 122 to the developing roller 114.

An agitator 121 is rotatably installed at the center of the toner chamber 120 in order to ensure reliable supply of the toner 122 and prevent the toner 122 from hardening. However, a cleaner for scraping non-transferred toner remaining on the OPC drum 111 or the charging roller 112 is absent in the earlier image forming apparatus. The resulting ghost or contamination of an image-absent area drops image quality.

Figure 2:
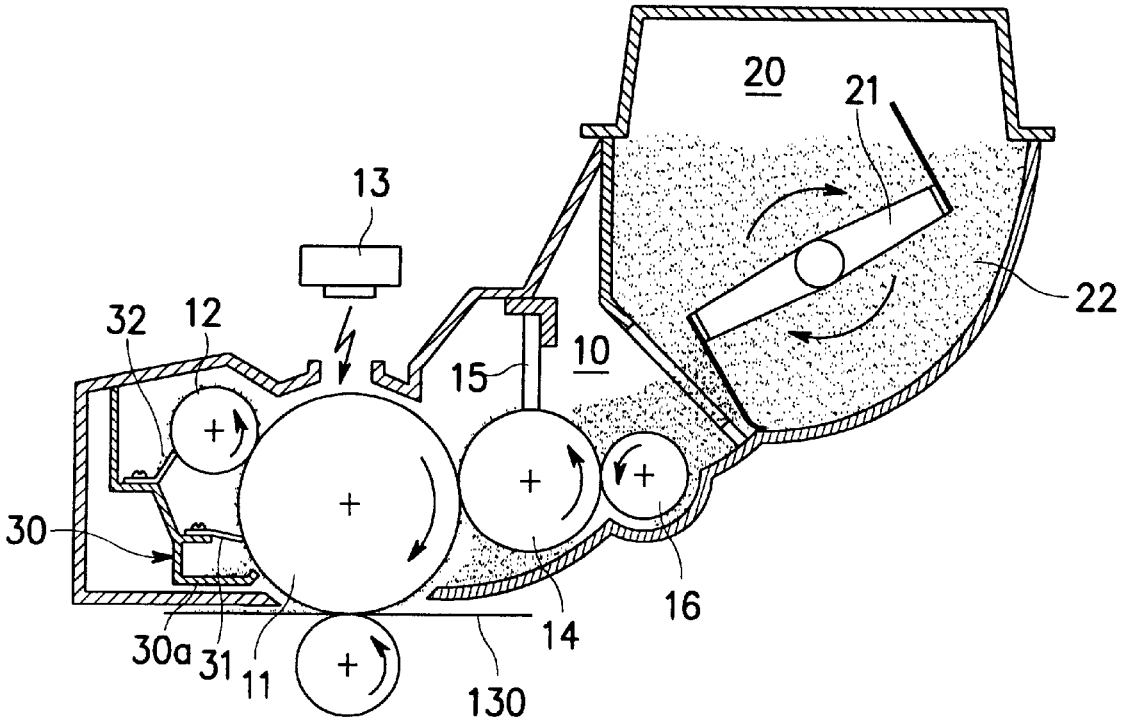
FIG. 2 is a schematic view of an image forming apparatus according to a preferred embodiment of the present invention.
Figure 3:
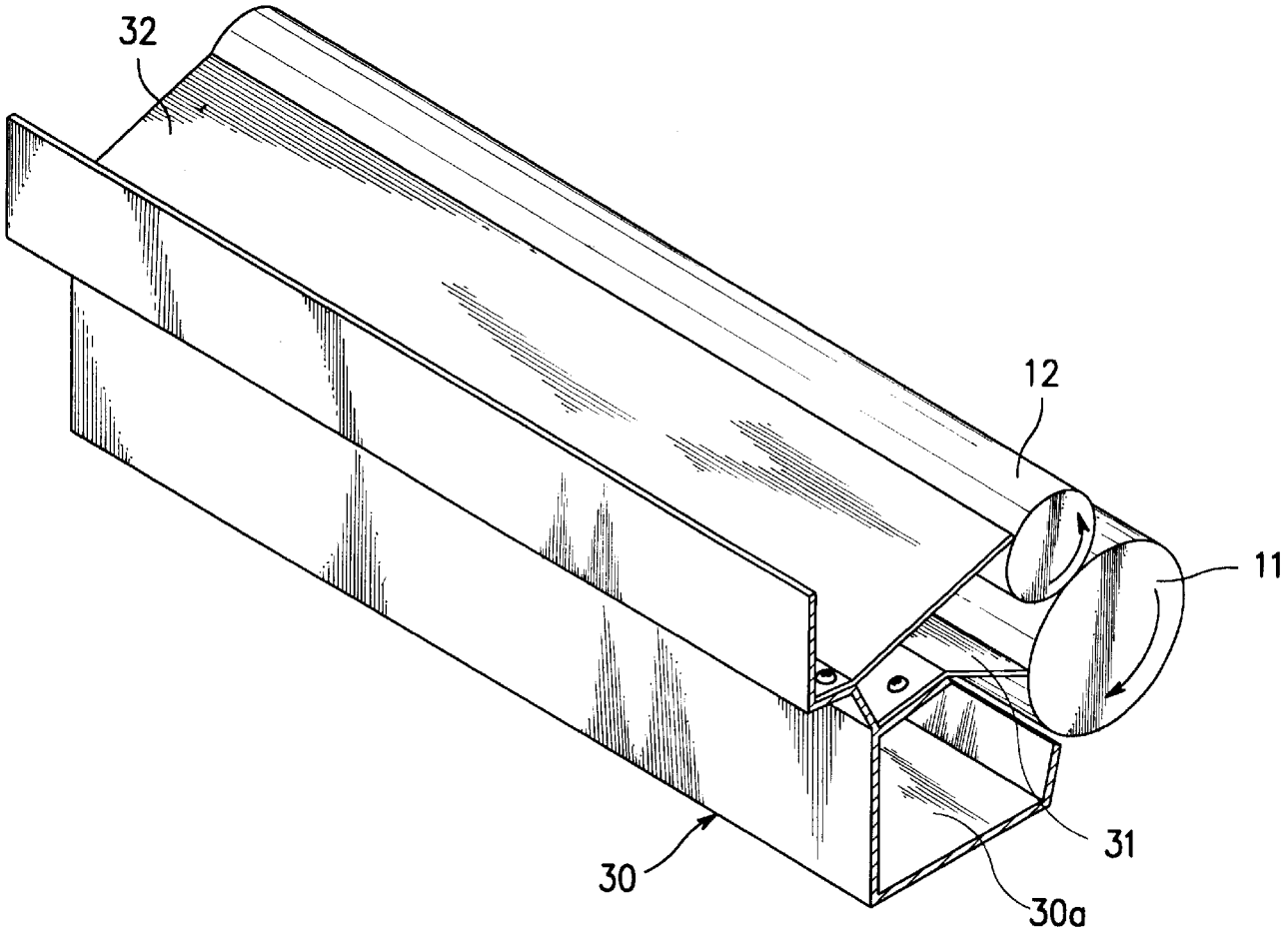
FIG. 3 is a partial perspective view of cleaning blades provided for an OPC drum and a charging roller according to the preferred embodiment of the present invention.

Referring to FIGS. 2 and 3, the image forming apparatus with cleaning blades according to the present invention includes a toner chamber 20 containing a large amount of toner 22 and a developer chamber 10 for forming an image on the paper sheet 130 with the toner 22 fed from the is toner chamber 20. The toner chamber 20 and the developer chamber 10 form a developer cartridge in a predetermined frame.

An OPC drum 11 is installed in an appropriate portion of the developer chamber 10, partially protruding from the lower surface of the cartridge, and rotates at a predetermined circumferential speed. At one side of the OPC drum 11 is rotatably installed a charging roller 12 for charging the surface of the OPC drum 11 with a high voltage. An exposer 13 is installed in a body above the OPC drum 11, for exposing the OPC drum 11 charged by the charging roller 12 to produce an electrostatic latent image. A developing roller 14 is rotatably installed at the other side of the OPC drum 11, for sticking the toner 22 onto the electrostatic latent image-present portion of the OPC drum 11. A doctor blade 15 has one end fixed to the frame of the developer chamber 10 and the other end in contact with the outer circumferential surface of the developing roller 14, for forming a predetermined toner layer on the surface of the developing roller 14. A supply roller 16 is provided opposite to the OPC drum 11 with interposition of the developing roller 14, for supplying the toner 22 to the developing roller 14. An agitator 21 is rotatably installed at the center of the toner chamber 20 in order to ensure reliable supply of the toner 22 and prevent the toner 22 from hardening.

A first cleaning blade 31 is fixed on a portion of a frame 30, in the vicinity of the OPC drum 11, for scraping non-transferred toner remaining on the OPC drum 11. A second cleaning blade 32 is fixed on another portion of the frame 30 above the first cleaning blade 31, in the vicinity of the charging roller 12, for completely scraping non-transferred toner which avoided the operation of the first cleaning blade 31. A toner waste reservoir 30*a* is integrally formed with the frame 30 under the first cleaning blade 31, for containing the scraped non-transferred toner. To secure a space for containing non-transferred toner scraped by the second cleaning blade 32, the second cleaning blade 32 is inclined upward at a predetermined angle.

In operation, the toner 22 is fed from the toner chamber 20 to the supply roller 16 by the agitator 21. Then, the toner 22 sticks to the developing roller 14 by frictional charging between the supply roller 16 and the developing roller 14. The displacement of the toner 22 on the developing roller 14 is regulated at a predetermined height by the doctor blade 15.

Meanwhile, the OPC drum 11 is charged with a high voltage by the charging roller 12 and an electrostatic latent image is formed on the OPC drum 11 by the exposer 13. Then, the toner 22 on the developing roller 14 sticks onto the electrostatic latent image of the OP(C drum 11 and a toner image is transferred onto the paper sheet 130 when the paper sheet 130 is introduced between the OPC drum 11 and an underlying transfer roller.

Subsequently to the transferring, non-transferred toner remaining on the OPC drum 11 is scraped by the first cleaning blade 31. The non-transferred toner which avoids scraping of the first cleaning blade 31 sticks to the charging roller 12 rotating in contact with the OPC drum 11 and is completely removed by the second cleaning blade 32.

As described above, the image forming apparatus of the present invention removes non-transferred toner by a double cleaning of cleaning blades provided respectively to the OPC drum and the charging roller, thereby preventing non-transferred toner-caused contamination of the surface of the OPC drum, and further, the resulting degradation of image quality.

While the present invention has been described in detail with reference to the specific embodiment, it is a mere exemplary application. Thus, it is to be clearly understood that many variations can be made by anyone skilled in the art within the scope and spirit of the present invention.

What is claimed is:

1. An electrophotographic image forming apparatus, comprising:

an organic photoconductive drum for forming an image;

a charging roller applying a high voltage to said drum;

a developing roller supplying toner to said drum;

a doctor blade regulating thickness of a layer of toner on the developing roller;

a supply roller supplying the toner to the developing roller;

an agitator supplying the toner to the supply roller;

a first cleaning blade disposed in a first position at a side of said drum, to scrape non-transferred toner from said drum after a transferring operation;

a second cleaning blade disposed in a second position at a side of said charging roller, to scrape non-transferred toner from said charging roller;

a housing partially surrounding said drum while encasing said charging roller, said first cleaning blade and said second cleaning blade;

a frame positioned within said housing, said frame comprised of a first flange spaced-apart from a second flange, and a third flange spaced-apart from said first flange and said second flange;

said third flange, in conjunction with said first flange and said first cleaning blade, forming a reservoir extending outwardly from said frame and toward said drum to store non-transferred toner received from said first cleaning blade; and said first flange maintaining said first cleaning blade in said first position and said second flange maintaining second cleaning blade in said second position while said frame resides within said housing.

2. The electrophotographic image forming apparatus of claim 1, further comprising said reservoir being formed under said first cleaning blade.

3. The electrophotographic image forming apparatus of claim 1, wherein the second cleaning blade is inclined upward at a predetermined degree to secure a space for retaining non-transferred transferred toner scraped by said second cleaning blade.

4. An electrophotographic image forming apparatus, comprising:

an organic photoconductive drum forming an image;

a charging roller applying a high voltage to said drum;

a developing roller supplying toner to said drum;

a doctor blade regulating thickness of a toner layer on the developing roller;

a supply roller supplying the toner to the developing roller;

an agitator supplying the toner to the supply roller;

a first cleaning blade located at a first position near said drum;

a second cleaning blade located at a second position near said charging roller to remove residual toner from said charging roller;

a housing encasing said charging roller, said first cleaning blade and said second cleaning blade;

a frame positioned within said housing, said frame comprised of a first flange spaced-apart from a second flange, and a third flange spaced-apart from said first flange and said second flange;

said third flange, in conjunction with said first flange and said first cleaning blade, forming a reservoir extending outwardly from said frame and toward said drum to receive non-transferred toner from said cleaning blade; and said first flange maintaining said first cleaning blade in said first position and said second flange maintaining said second cleaning blade in said second position.

5. The electrophotographic apparatus of claim 4, further comprising:

said frame orienting said first blade to scrape residual toner from said photoconductive drum and orient said second blade to remove excess toner that was not removed by said first blade.

6. The electrophotographic apparatus of claim 5, further comprised of said frame maintaining said first blade and said second blade in a spaced apart relation.

7. A cleaning device for a electrophotographic machine, comprised of:

a photoconductive drum forming an image;

a charging roller aligned to apply a voltage to an exterior surface of said photoconductive drum;

a first blade located at a first position to remove toner from said exterior surface;

a second blade located at a second position to remove residual toner from said charging roller;

a housing encasing said charging roller, said first blade and said second blade;

a frame positioned within said housing, said frame comprised of a first flange spaced-apart from a second flange, and a third flange spaced-apart from said first flange and said second flange;

said third flange, in conjunction with said first flange and said first blade, forming a reservoir extending outwardly from said frame and toward said drum to receive non-transferred toner from said first blade; and said first flange maintaining said first blade in said first position and said second flange maintaining said second blade in said second position.

8. The cleaning device of claim 7, further comprising said first blade located in proximity to said photoconductive drum removing residual toner from said exterior surface after a transferring operation.

9. The cleaning device of claim 7, further comprised of said second blade removing toner that avoids the cleaning operation of said first blade.

10. The cleaning device of claim 7, further comprising said first flange maintaining said first blade spaced-apart from said second blade.

11. The cleaning device of claim 7, further comprised of said frame forming a single integrated monolithic unit.

12. The cleaning device of claim 7, further comprised of said second blade being inclined upward at a predetermined degree to secure a space separate from said reservoir for retaining non-transferred toner scraped by said second blade.

13. The cleaning device of claim 7, wherein said first blade is fixed on a first portion of the frame near the drum and said second blade is fixed on a second portion of the frame distanced from the first portion of the frame and in the vicinity of the charging roller.

14. The cleaning device of claim 7, further comprising said first flange maintaining said first blade distanced from said second blade and said blades oriented such that said blades cooperate to provide a means for completely scraping away non-transferred toner.

15. The cleaning device of claim 7, further comprised of said second blade being inclined upward at a predetermined degree to secure a space separated from said reservoir for retaining non-transferred toner scraped by said second blade.

16. A cleaning device for an electrophotographic apparatus, comprising:

a photoconductive drum forming an image on a sheet of paper;

a charging roller applying a high voltage to the photoconductive drum;

a first blade located at a first position to remove toner from said exterior surface;

a second blade located at a second position to remove residual toner from said charging roller;

a frame comprised of a first flange spaced-apart from a second flange, and a third flange spaced-apart from said first flange and said second flange;

said third flange, in conjunction with said first flange and said first blade, forming a reservoir extending outwardly from said frame and toward said drum to receive toner from said first blade; and said first flange maintaining said first blade in said first position and said second flange maintaining said second blade in said second position.

17. A method for cleaning an electrophotographic apparatus, comprising the steps of:

transferring toner from a developing roller to a photoconductive drum;

exposing an image on said photoconductive drum;

transferring said toner image from said photoconductive drum onto a sheet of paper;

cleaning off residual toner left on said photoconductive drum by allowing a first blade to be positioned in operational relationship near said photoconductive drum to remove excess toner from the surface of said photoconductive drum, said first blade attached to a frame within a housing which partially surrounds the drum;

storing said residual toner in a reservoir disposed within the housing and beneath said first blade;

cleaning off remaining toner transferred onto a charging roller encased within the housing, by allowing a second blade attached to said frame to be positioned in operational relationship near said charging roller to remove excess toner from the surface of said charging roller that avoided the cleaning operation of said first blade; and depositing said remaining toner in a space separate from said reservoir.

18. The method of claim 17, further comprising maintaining said first blade spaced-apart from said second blade.

* * * * *